United States Patent [19]

Taub

[11] Patent Number: 4,703,703

[45] Date of Patent: Nov. 3, 1987

[54] VARIABLE WIDTH, TIERED DISPLAY STAND

[76] Inventor: Ronald H. Taub, 175 E. Delaware Pl., Chicago, Ill. 60611

[21] Appl. No.: 901,123

[22] Filed: Aug. 28, 1986

[51] Int. Cl.[4] ..... A47B 47/00

[52] U.S. Cl. ..... 108/111; 211/126

[58] Field of Search ..... 108/111, 91, 109; 211/126, 188, 194

[56] References Cited

U.S. PATENT DOCUMENTS

| | | | |
|---|---|---|---|
| 2,317,645 | 4/1943 | Ryan | 211/126 |
| 3,685,465 | 8/1972 | Hanmer | 108/111 |
| 3,951,080 | 4/1976 | Roberts | 108/109 |
| 3,982,638 | 9/1976 | Lamson | 211/194 |
| 4,138,015 | 2/1979 | Rabley | 211/126 |
| 4,353,470 | 10/1982 | Polhemus et al. | 211/126 |

*Primary Examiner*—Francis K. Zugel
*Attorney, Agent, or Firm*—Norman Lettvin

[57] ABSTRACT

A variable width tiered display stand, which may be supplied in knocked-down condition, and which may be readily assembled at the site of use, is disclosed.

The stand provides multiple tiers, each adapted for support of a box of boxed goods thereon, to provide an attractive means for display, and offer, of goods to prospective customers, while permitting the shopkeeper to easily withdraw empty boxes of goods from the tiers and to insert fresh boxed goods on the tiers as may be required or desired.

The stands are preferably made of transparent plastic parts which may be easily fit together, and which do not require additional fastener means for keeping the tiered display stand assembled.

7 Claims, 5 Drawing Figures

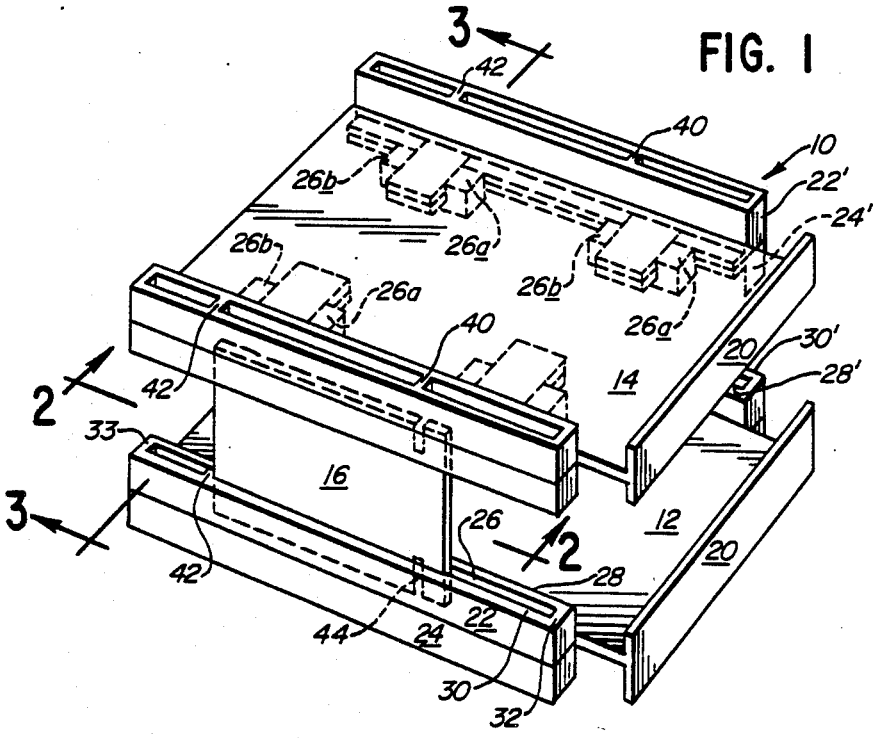
FIG. 1
FIG. 2
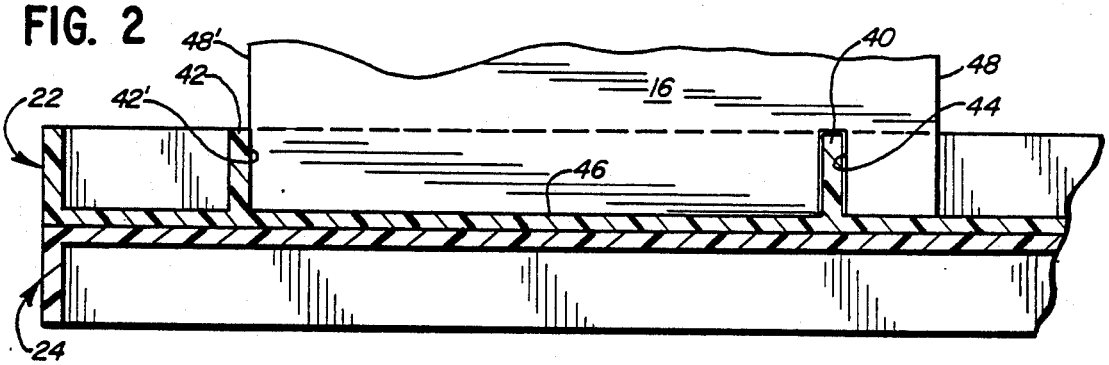
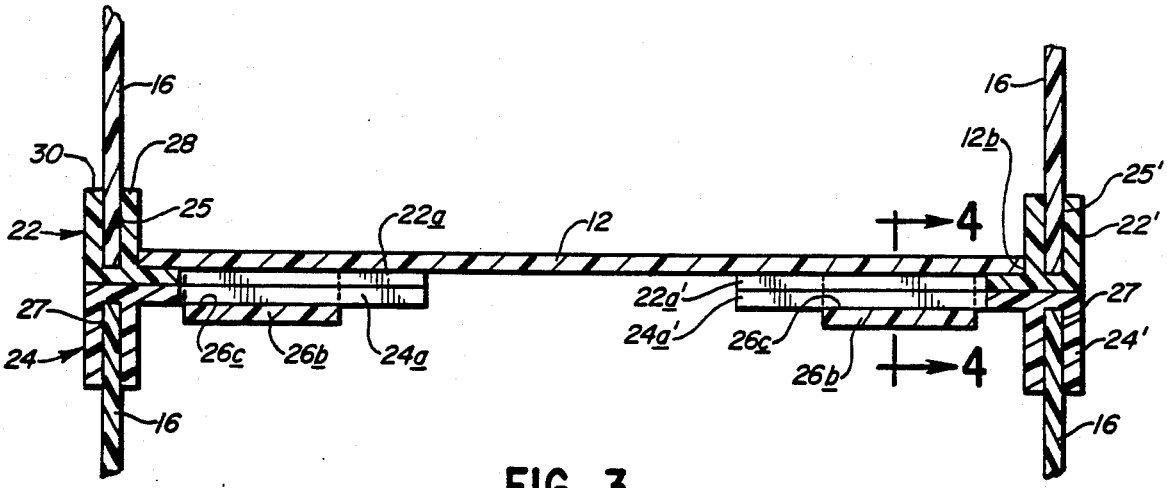
FIG. 3

FIG. 4
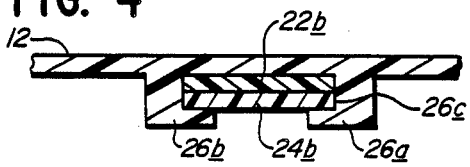
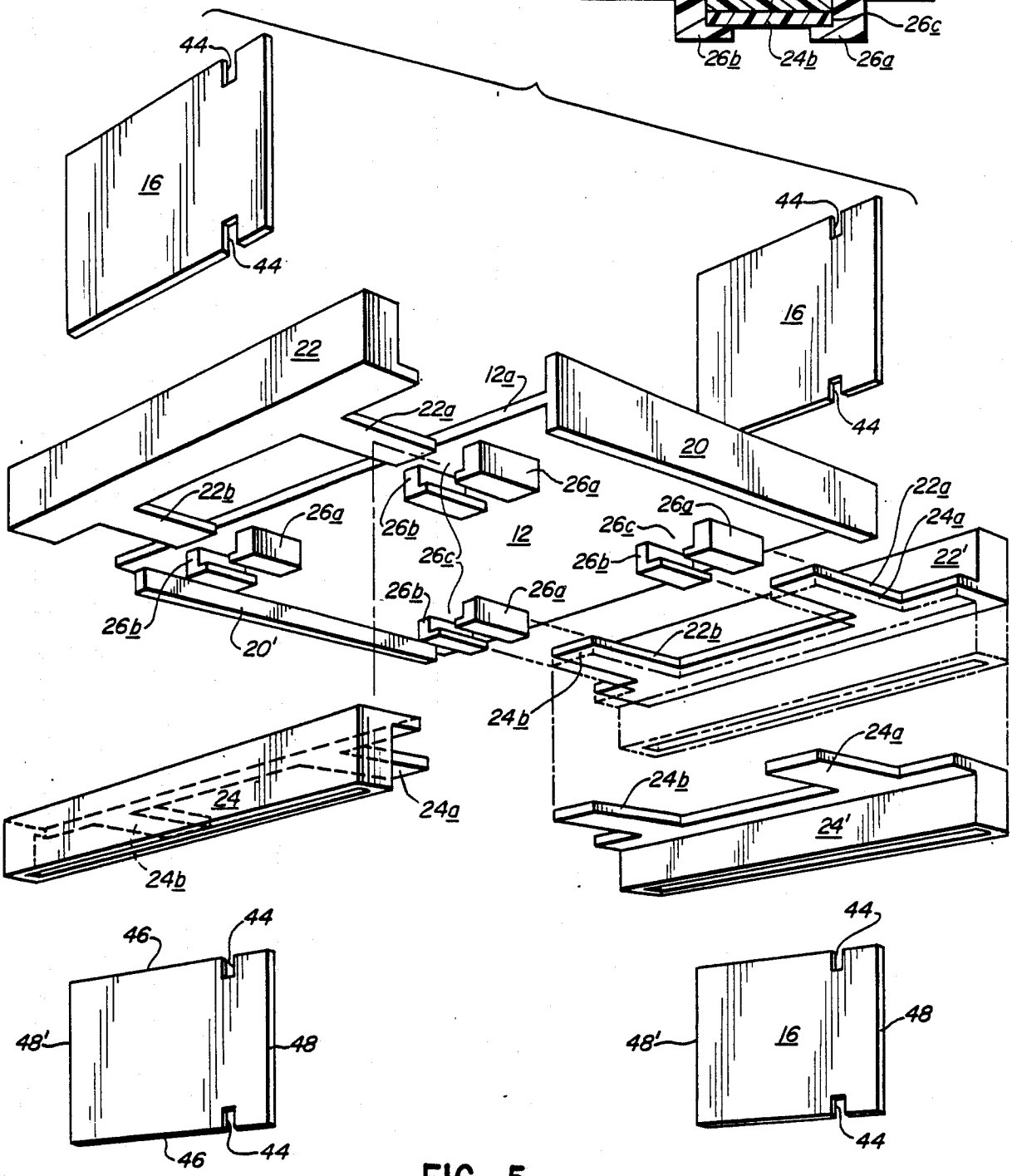
FIG. 5

VARIABLE WIDTH, TIERED DISPLAY STAND

FIELD OF THE INVENTION

This invention relates to an improved, multi-tiered, storage and/or display stand for displaying to customers, on store counters or the like, a plurality of pre-packaged boxed goods, such as candy bars or the like, packaged in boxes of different sizes.

BRIEF DESCRIPTION OF PROBLEMS ASSOCIATED WITH PRIOR ART

It is known to tier displays of goods, such as pre-packaged, boxed articles, on counters in stores, or shops, where display counter space is at a premium. The prior art discloses that tiered displays normally provide support shelves, of preselected and uniform size, for supporting articles on vertically spaced, horizontal or inclined, shelves. The construction of prior tiered stands normally positions shelves of the same size in vertical arrays.

The use of uniform width tiers, or shelves, frequently prevents lack of flexibility, such as where it is desired to display, on the multiple tiers of the same display device, goods that have been pre-packaged, by their manufacturers or packers, in boxes of different width.

OBJECTS OF THIS INVENTION

It is one object of this invention, to provide an attractive stacking display of support shelves, or tiers, that provide improved viewing of boxed goods, that are located on the shelves or tiers at different levels, or on vertically spaced tiers, of a stacking display.

Another object of this invention is to provide flexibility in a stacking display for goods, by providing shelves whose width dimension may be selectively varied to accommodate boxes of different width that contain articles, such as individually wrapped chocolate bars or candy bars, that are to be displayed on a store counter, or the like, while permitting customer-selection of goods from any and all of the tiers of the display.

It is another object of this invention to provide a new and improved stacking display that is characterized by simplicity of construction, ease of assembly, increased viewing attractiveness, being of knockdown construction to permit shipping the parts thereof in a compact arrangement, and which stacking display, when assembled, providing for display of boxes of goods, of different lateral sizes, on selected vertically spaced tiers of the display.

Further objects and advantages of my invention will become apparent to one skilled in the art from the following description of the invention disclosed herein.

BRIEF DESCRIPTION OF PRIOR ART

It is known to provide an array of trays for carrying articles thereon, wherein the trays are vertically spaced apart, or tiered. See U.S. Pat. Nos. 2,575,919; 2,901,120; and 3,095,093. In said tiered tray arrays, the support shelf for articles carried in the tray are positioned either horizontal or nearly horizontal, and a plurality of spaced upright sides are provided, that are formed integral with the support wall or are attached to the support wall, to form basket-like units for receiving articles into or onto the trays. Tiering of any two similar trays usually is accomplished by using multiple vertical rod-like supports, or spacers, which extend between corresponding walls or the tiered tray arrays. U.S. Pat. No. 2,901,120, discloses use of tiered trays whose support shelves are of different size, and wherein the difference in size extends from back to front, but with the width sizes of the tiered trays being the same.

Stacks, or tiers, of trays that display goods, for customer selection therefrom, are also known, such as disclosed in U.S. Pat. No. 2,916,293 which discloses the inclining of all tiers of trays so that articles therewithin will move, by gravity, downwardly and forwardly toward the forward upright edge of the tray, as articles are removed from a forward portion of the tray. After the topmost tray has been emptied, the emptied tray must be removed to permite access to goods in the tray tier below the emptied tray.

A stand, made up of laterally spaced pairs of inclined, upwardly converging, tubular support leg frames, with transverse wire tier supports, whose transverse ends telescope into apertures provided in the tubular supports, and with straps for limiting the front-to-rear length of the tiers of the stand, and with a plurality of inclined, tier bottoms formed of longitudinal wires, that have vertical, front end, plate-like panels located at the forward end of each tier, is illustrated, but not described as to structure or use, in U.S. Design Pat. No. 162,990.

SUMMARY OF THIS INVENTION

A stacking, tiered, display stand is disclosed herein which provides multiple, vertically spaced, planar support tiers each of which is adapted to support thereon boxed articles, such as boxed chocolate bars or candy bars.

The multiple tiered display stand disclosed herein has its tiers horizontal, for being mounted on a horizontal countertop. However, it will be understood, by one skilled in the art, that the stacked display tiers may also be mounted on inclined support means, so that the display tiers will be inclined forwardly on a supporting horizontal countertop.

The stacking, tiered, display of this invention may be easily assembled at or adjacent the point of usage by store personnel, and is preferably made up of a plurality of clear plastic parts to provide an attractive display stand which permits customer viewing, from different aspects, of the goods being offered for sale.

The stacking, tiered, display that is disclosed herein has knock-down character, to provide for compact volume in shipping, and provides for simple assembly at, or adjacent, the point of use.

Each tier of the display tray has a pair of selectively adjustable lateral rails for varying the operative width of the support shelf of each tier, to accommodate boxes of different widths on the respective tiers of the display, thereby providing a flexible use display, and an attractive vending apparatus for counter-displayed goods. Each pair of vertically spaced shelves have pairs of laterally spaced rails which cooperate with vertically spaced rails of a higher or lower tier, so as to provide vertical supports between pairs of vertically spaced tiers. Simple, plate-like spacers serve as load transmitting columns that are used for spacing and supporting one tier above a support tier therebelow.

In the display rack disclosed herein, each tray, or tier, of a multiple-tiered rack includes a pair of rails positioned adjacent each of the two longitudinal edges of each tray. The two rails each include an upper rail positioned to bound one of the spaced longitudinal edges of the region that supports the box of goods positioned on the tier. Each pair of vertically aligned rails, use columnar members which extend between the pair of rails to provide vertical support for one tier positioned above a tier that is located therebelow.

BRIEF DESCRIPTIONS OF THE DRAWINGS

FIG. 1 is a perspective view of an assembled two-tiered display rack embodying the features of this invention and illustrating in full lines part of the construction of one pair of adjacent upper and lower edge rails of the two tiers of the display tray;

FIG. 2 is an enlarged, fragmentary, cross-sectional view, taken substantially on line 2—2 of FIG. 1, which is located in a plane about midway between the innermost and outermost side walls of the pair of abutting upper and lower rails along the left-hand edge of lower shelf 12, and shows details of a pair of abutting side rails located along one lateral edge of a support shelf of the lower tier of the two-tiered display rack shown in FIG. 1, FIG. 3 is a fragmentary cross-sectional view taken substantially on line 3—3 of FIG. 1 and showing additional details of a typical edge rail construction for one shelf of the tiered display rack, and by means of which the effective width of a horizontal support tier may be selectively set, and also illustrating, in fragment, the use of vertically oriented, planar spacers cooperating with the construction of the side rails for spacing pairs of tiers vertically and for supporting an upper tier by the next adjacent lower tier of the stand;

FIG. 4 is a fragmentary cross-sectional view taken on line 4—4 of FIG. 3, showing the assemblage of a pair of tongues extending from the pair of side rails located along one edge of one tier of the display rack of FIG. 1; and FIG. 5 is an exploded view showing details of one support tier shelf of the display rack shown in FIG. 1, with an illustration of details of the spaced slide holders that are provided on the underside of a tier plate and are adapted for receiving thereinto pairs of adjacent tongues that extend from the pair of side rails that are provided along each side edge of a tier shelf, and also illustrating in exploded, or separated, relationship the spacer plates that extend vertically between rails adjacent the edges of each tier plate, to provide the means for vertical spacing of a pair of support tiers of the display rack, with the upper tier being supported by the lower tier through use of columnar-like plate supports.

DETAILED DESCRIPTION OF THE INVENTION

Referring now to the drawings, and particularly to FIG. 1, a two-level storage and display rack, adapted for mounting on a store counter, is shown generally at 10. The storage rack shown in FIG. 1 has only two tiers, but more tiers may be provided using vertical spacers, as shown in FIGS. 3 and 5, to space the additional tiers apart.

Each shelf, or tier, of the two-tiered display rack example of FIG. 1 may be provided of a size, to have supported thereon, the goods-containing portion of a box of counter goods, such as chocolate bars, chewing gum, or other goods that the store keeper may be offering for sale. A five-tiered rack, using structural elements as disclosed hereinafter, has been constructed and has been demonstrated to be of stable construction.

The horizontally elongated shelf of the lowermost tier of display rack 10 is generally indicated by numeral 12, with an upper, second, horizontally elongated tier shelf 14 spaced above said lowermost tier shelf 12. Each of the tier shelves 12 and 14 has associated, elongated, edge rails that are similarly constructed, so that a detailed description of the edge rail elements, and other features of construction of the lower tier shelf 12 will operate to provide a description of similar elements shown associated with the second tier shelf 14. Some elements, such as the specific vertical, columnar, side spacers 16, that are positioned to extend between side rails associated with the two shelves 12 and 14 are shown assembled only in FIGS. 1–3, in position on vertically aligned side rails to serve as a spacer and a support. The exploded view of FIG. 5 illustrates how these vertical spacers may be used either above or below a tier that includes one horizontal tier shelf for supporting another tier shelf, and these spacers may, for example, be used below the tier shelf 12 shown in FIG. 5, or between a pair of tier shelves 12 and 14, to serve to either support the lowermost tier above a counter, or to space a next higher tier above a next lower tier.

In the specific illustrations in the Figures, the lower tier includes a flat, planar, horizontal support shelf member 12. The forwardmost end of shelf member 12 is provided with a transverse abutment wall 20 that lies in a plane transverse to the plane of shelf member 12, and is secured to shelf member 18 by any means, such as by being glued or melded thereto.

The portion of the transverse, forward abutment wall 20 that extends above the upper surface of shelf 12, is positioned to serve as an abutment against which a wall of a body, or box, that is supported on shelf 12 may abut. The rear end of the storage and display rack 10, that is opposite forward wall 20, is open, so that an attendant may easily withdraw an empty box supported on the shelf 12, and insert onto the shelf 12, from rearwardly of the rack 10, a fresh, or replacement, box with goods therein.

The lower tier shelf 12 is provided, along each of its longitudinal edges, with associated, elongated, upper and lower rail members, respectively 22 and 24, whose assembled structural portions are best seen in FIGS. 1–4, and whose overall shape may be seen in perspective in FIG. 5.

An upper rail member 22, located adjacent to the left edge of shelf member 12, as viewed in FIGS. 1 and 3, includes an elongated, upper side rail, or body, that is provided with an elongated upwardly-opening groove means 25 in the upper edge of rail member 22 that is bounded by spaced, upright, inner and outer, longitudinal side walls, 28 and 30, that are spaced by transverse end walls 32 and 33. The upper side rail along the right hand longitudinal edge of shelf 12 is of similar construction and is designated 22', and with the parts thereof using the same identifying numeral with a prime (') mark.

As seen in FIG. 3, when a shelf, such as shelf 12, and its side rails are assembled, only a portion of the total height of upper rails 22 and 22' extend above the upper surface of shelf 12. The lower rails 24 and 24' each are of mirror image construction relative to its adjacent upper side rails 22 and 22'. But while upper rails 22 and 22' have only portions thereof located vertically above the plane of adjacent shelf 12, the lower edge rails 24 and 24' have all portions thereof located below the plane of shelf 12.

The lower edge rails 24 and 24' each also include a downwardly opening elongated recess or groove 27 that is located in a mirror-image relation to the similar structures provided in upper rails 22 and 22', but as seen in FIG. 3, all portions of lower side rails 24 and 24' are located below the plane in which shelf 18 is located.

One purpose of having a pair of laterally spaced upper rails 22 located adjacent the two longitudinal edges of shelf 12 is to provide a pair of longitudinal elements that may be moved toward or away from each other to engage, or accommodate, the width of the box that rests on shelf 12, where the box is at least as wide as, or or wider than, the shelf 12. If the width of a rectangular box on shelf 12 is less than the width of shelf 12, then, at most, only one side wall of the box might be engaged by the innermost side of one of the two upper rails 22 or 22'.

Since each of the two upper rails 22 and 22' are mirror images of each other, the similar elements on rail 22' carry the same identifying numeral as appears on rail 22, but with a prime mark (') added.

It will now be seen, from FIGS. 1, 3 and 5 together, that the upper and lower rail members adjacent the side edges of shelf 12 have an exterior shape that is essentially the same. It will be understood that, if desired or necessary, the rail members themselves may be provided with selected interior shapes and walls for receiving and cooperating with spacer members of different size as may be necessary, or desired. However, for purposes of the description herein, it is to be understood that all rail members will be fundamentally of the same shape and size, except as may be needed to provide a modification.

FIGS. 1 and 3 illustrate how a pair of upper, side rail members, 22 and 22', are each assembled alongside the two longitudinal edges of both lower shelf 12 and upper shelf 14.

The underside of each shelf, 12 and 14, includes the same structure as shown on the underside of shelf 22 in the exploded perspective view of FIG. 5. Thus, the underside of each tier shelf, 12 and 14, is provided with two pairs of spaced angle sections **26*a* and 26*b* that are secured, or otherwise adhered to, or melded with, the undersurface of said shelves to make an integral structure adjacent each of the two lateral edges of the shelf. Also, and so that shelf 12 will not tilt, or slope, from front to back, the rear end of shelf 12 is provided with a rail 20', seen in exploded FIG. 5, which extends below shelf 12 the same distance that the lower portion 20*a*, of transverse abutment wall 20, extends below shelf 12**.

As best seen in FIG. 5, a shelf, such as either the planar support shelf 12 or 14, has affixed to the underside thereof, such as by gluing, or melding, two sets of socket angle sections, **26*a* and 26*b*, that lie respectively adjacent the lateral shelf edges 12*a* and 12*b*. Although aligned sets of separated socket angle sections 26*a* and 26*b* are shown, elongated angle-shaped sections, of the cross-section seen in FIG. 4, could be used instead, and then the end portions of said elongated sections would be the equivalent of the structures shown. The said socket angle sections, together with the underside of the shelf 12 to which the socket angle sections attach, provide generally socket-like, or generally rectangular, tubular-like, sockets, or tongue-holding means, indicated at 26*c*, for slidably receiving thereinto, or therethrough, lateral extensions, or tongues, 22*a* and 22*b*, that extend from an upper rail 22. The same sockets, or tongue-holding means, also receive lateral extensions 24*a* and 24*b* that extend from a lower rail 24, as is seen in FIG. 3**.

As best seen in FIG. 3, when a shelf 12 or 14 has its rails 22 or 24 assembled thereon, the socket angle sections **26*a* and 26*b* are of a size and spacing from the underside of the associated shelf 12, so that the two adjacent tongues, 22*a* and 24*a*, or 22'*a* and 24'*a*, of the two rails 22 and 24 are held by the tongue-holding means against the undersurface of a planar support, such as 12 or 14, in each socket space 26*c* provided between spaced, angled, flange sections 26*a* and 26*b***.

The cross-sectional view of FIG. 3 shows the upper rails 22 and 22', when moved to their closest spacing, which is controlled or dictated, by the fact that upper rails 22 and 22', as seen in FIGS. 1 and 3, abut opposite lateral edges of shelf 12, with rail 22 abutting shelf edge **12*a* while rail 22' abuts an opposite shelf edge 12*b*, as seen in FIG. 3. The lower rails 24 and 24' are not so constrained, but lower rails 24 and 24', are preferably to be selectively moved into a position of vertical alignment with a set of upper rails 22 and 22', as best seen in FIG. 1**.

Alternatively, lower rails 24 and 24', may be selectively moved laterally inwardly until said rails abut the edges of angle flange sections **26*a* and 26*b*, or may be moved laterally outwardly of the position shown in FIG. 3, provided that some portion of tongues 24*a* and 24'*a* are not moved outwardly to a position where all portions of tongues 24*a* and 24'*a* escape the tongue holding means provided by socket angle sections 26*a* and/or 26*b***.

Considering the structure shown in FIG. 3, the lower rails, 24 and 24', could be moved inwardly toward each other until an innermost portion of those rails abut an edge of the socket angle sections **26*a* and 26*b***.

Referring now to the manner of effecting selective vertical spacing between the support shelves 12 and 14, or between shelf 12 and the top of a counter upon which the tiered display of FIG. 1 is supported, or between upper shelf 14 and a third shelf thereabove, the means for effecting such spacing utilizes the fact that each rail member 22, 24, 22' and 24' is provided with an interior groove means, such as the upwardly opening groove means 26 of rail 22, that is bounded longitudinally, such as by side walls 28 and 30 as described above, and as seen in FIGS. 1–3 and 5.

More specifically, the groove means 26 does not provide a continuous slot along the length of its rail. Instead, each rail, such as rail 22 seen in FIGS. 2, 3 and 4, and rail 24 as seen in FIGS. 3 and 5, includes, in the groove means for the rail, one or more transverse ribs such as 40 and 42, that are clearly shown in FIG. 2.

To cooperate with such groove means and its transverse ribs 40 and/or 42, there are provided vertical spacers, or columnar spacer means, in the form of planar, spacer plates 16, referred to earlier above. These planar spacer plates 16 are of a thickness to slidably fit into the longitundinal space between spaced side walls 28 and 30 of a rail member 22 or 24. Within the longitundinal space between the spaced side walls 28 and 30 of the rail member, there are provided one or more transverse ribs 40 and 42 as seen in FIG. 2.

The shape of spacer plates 16 are most clearly seen in FIGS. 1, 2 and 5. Spacer plates 16 are rectangular in elevation as seen in FIG. 5 with their length edges 46 being greater than their height edges 48. As will appear from the following description, the rectangular spacer plates provide for two alternative spacings between shelves 12 and 14.

A pair of opposed notches, 44, extending from the length edges of spacer plate 16, are provided in alignment with each other and extend toward each other from the long edges 46 of the rectangular plate 16. The length of the short edges 48 and 48' of plate 16 provides an effective measure of one spacing between an aligned upper rail 22, associated with lower shelf 12, and a lower rail 24, associated with upper shelf 14, spaced thereabove as seen in FIG. 1.

The notches 44 are of a size and shape to permit a spacer plate 16 to fit over a transverse rib 40 or 42, here shown, in FIG. 2, to be rectangular in cross section. The spacing of notch 44 from the distal short edge 48' is selected so that when a notch 44 receives therein a rib 40, as seen in FIG. 2, the distal short edge 48' of plate 16 will slide against, and engage the closest edge 42' of rib 42, as shown in FIG. 2. Similar ribs provided in an opposite rail member, such as rail members 24 or 24' (seen in FIG. 5) permits the spacer plate to provide for firm engagement and interconnection between a pair of oppositely facing rail members, such as between one lower rail 22 and an opposed upper rail 24, as seen in FIG. 1.

If a greater spacing is desired between a pair of shelves 12 and 14, the spacer plates 16 are to be rotated ninety degrees (90°) from their length position seen in FIG. 1 to a width position where edges 48 and 48' take the positions shown for long edges 46 as seen in FIG. 5. The length of edges 48 and 48' are selected so that long edges 46 of a spacer plate 16 will slidingly fit between ribs 40 and 42. In this latter arrangement, since a shorter edge of spacer plate 16 is captured in a groove, the spacing between a pair of spaced shelves 12 and 14 will be greater.

The spacer plates may also be used as a pair of free legs to support lower rail members 24 and 24' upon the surface of a flat counter, as suggested by the lower truncated spacer plates shown extending downwardly in FIG. 3.

By inclining, or beveling the lower edges, of a pair of laterally spaced support legs extending downwardly from lower rail members 24 and 24', the tiered display stand may be converted to a stand wherein the goods supported thereon are displayed at an inclined attitude, with the goods on a shelf, such as shelf 12, engaging the upper front flange 20 located at the forward end of a support shelf plate 12 or 14.

The material used in making the various parts shown in the Figures of the drawings are a transparent plastic, thereby creating a tiered display stand that is eye-catching and attractive, while at the same time providing the rigidity and strength needed to serve the purpose as a display stand. The nature of the plastic material permits ease in forming and assembly, yet provides for inexpensiveness of construction and strength for the intended purposes.

While a particular embodiment of this invention has been shown and described, it will be obvious to those skilled in the art that various changes and modifications may be made therein without departing from the spirit and scope of the invention and, therefore, it is intended in the appended claims to cover all such changes and modifications which fall within the true spirit and scope of the invention.

What is claimed is:

1. In a multi-tiered display and vending rack, that is adapted, when assembled, to be supported on a counter to provide a plurality of vertically spaced tier shelves, one spaced above another, and with each tier shelf adapted to support thereon goods to be vended;

the improvement of providing a plurality of vertically spaced, elongated tier shelves, each of which is constructed and arranged to support thereon a container of goods to be vended;

each of the tier shelves having a pair of abutting, elongated, upper and lower rails positioned adjacent each longitudinal edge of the shelf, each rail of said pairs of rails being selectively laterally slidable relative to the other and to the shelf, whereby to provide for different selected lateral spacings of each rail relative to its associated shelf;

each pair of rail means associated with one side of a tier shelf including a lower rail having a rail portion that is adapted to be vertically aligned with a portion of an upper rail of a tier shelf therebelow; and columnar spacer means extending between said aligned portions of said pair of vertically aligned rails, to provide vertical support between adjacent pairs of lower and upper shelves, and with the tier shelves providing means for supporting boxed goods on the respective supporting tier shelves of the vending rack.

2. A construction as in claim 1 wherein the means which provide support for each support shelf includes laterally elongated tongue means, which extend from each one of a pair of abutting upper and lower rails to a position below an adjacent support shelf to provide support for the underside of said adjacent support shelf;

at least one sleeve-like, tongue means holder being mounted on the underside of each support shelf and adjacent one longitudinal side edge of the support shelf, and said sleeve-like, tongue means holder being positioned, and constructed to receive thereinto means that extend from the pair of upper and lower rails, so that the sleeve-like holder will hold said rails adjustably attached to the support shelf.

3. A construction as in claim 2 wherein the means that extend from each rail means includes a pair of laterally elongated tongues which extend transversely from each upper and lower rail toward, but being spaced laterally from, the opposite upper and lower rails for the same tier, and with the pair of tongues that extends from the lower rail lying against the pair of tongues that extends from the upper rail, which in turn abut the underside of the support shelf.

4. A construction as in claim 2 wherein the underside of each support shelf is provided with longitudinally spaced pairs of sleeve-like holder means, each projecting below the plane of the support shelf, and through each of which extend tongues, that project respectively from a pair of abutting upper and lower rails.

5. A construction as in claim 4 wherein the underside of each support shelf is provided with two sleeve-like holder means, one such means being adjacent each of the two longitudinal edges of the support shelf; each sleeve-like holder means being arranged to receive thereinto a pair of tongues that extend from a pair of adjacent upper and lower rails, to provide a secure, but selectively laterally adjustable connection, between each pair of rails and the associated support shelf.

6. A construction as in claim 1 wherein each of the rails means is provided with a longitudinal groove therein, and with a column-like support plate, having its respective opposed ends insertable into the longitudinal grooves of opposed spaced rails to provide for support of each tier upon the next adjacent tier spaced therebelow.

7. A construction as in claim 1 wherein the columnar spacer means includes pairs of column-like, support plates, each of generally rectangular periphery providing pairs of spaced short edges and pairs of spaced long edges, of the support plates, and the arrangement of pairs of edges of the columnar support plates in the longitudinal grooves of opposed rails associated with tiers providing means for selecting the spacing of pairs of tier shelves of the display and vending rack.

* * * * *